US011517998B2

(12) United States Patent
Persson

(10) Patent No.: US 11,517,998 B2
(45) Date of Patent: Dec. 6, 2022

(54) GRINDING JIG FOR A BLADE TOOL

(71) Applicant: Tormek AB, Lindesberg (SE)

(72) Inventor: Håkan Persson, Lindesberg (SE)

(73) Assignee: TORMEK AB, Lindesberg (SE)

( * ) Notice: Subject to any disclaimer, the term of this patent is extended or adjusted under 35 U.S.C. 154(b) by 384 days.

(21) Appl. No.: 16/839,159

(22) Filed: Apr. 3, 2020

(65) Prior Publication Data

US 2020/0316748 A1 Oct. 8, 2020

(30) Foreign Application Priority Data

Apr. 5, 2019 (SE) ..... 1950422-4

(51) Int. Cl.
*B24B 41/06* (2012.01)
*B24B 3/54* (2006.01)
*B24D 15/08* (2006.01)

(52) U.S. Cl.
CPC ..... *B24B 41/066* (2013.01); *B24B 3/54* (2013.01); *B24D 15/08* (2013.01)

(58) Field of Classification Search
CPC ..... B24B 41/066; B24B 3/54; B24B 3/38; B24D 15/08; B23Q 3/02
USPC ..... 451/365
See application file for complete search history.

(56) References Cited

U.S. PATENT DOCUMENTS 1,770,538 A 7/1930 Warner
1,831,863 A 11/1931 Irwin
2,638,720 A 5/1953 Hoek
2,898,709 A 8/1959 Bednarski
3,543,446 A 12/1970 Kilian
3,800,632 A 4/1974 Juranitch
4,320,892 A 3/1982 Longbrake
4,338,749 A * 7/1982 Kiser ..... B24B 41/066 451/369
7,033,247 B2 * 4/2006 Zhang ..... B24B 3/36 451/5
7,488,241 B2 2/2009 Elek et al.
(Continued)

FOREIGN PATENT DOCUMENTS

CN 2723106 Y 9/2005
EP 0214943 A2 3/1987
(Continued)

OTHER PUBLICATIONS

Swedish Office Action for Swedish Application No. 1950422-4 dated Sep. 19, 2019 (8 pages).
(Continued)

*Primary Examiner* — Nhat Chieu Q Do
(74) *Attorney, Agent, or Firm* — Knobbe Martens Olson & Bear LLP

(57) ABSTRACT

A grinding jig for holding a blade tool having an edge in a grinding machine. The grinding jig may have a first and a second clamp half arranged to hold between them at least a portion of a blade tool. An elongate support portion may support the grinding jig onto a support bar of a grinding machine. The elongate support portion may comprise a front end abutment surface and a rear end abutment surface. The front and rear end abutment surfaces may be spaced to receive a portion of a support bar such that the grinding jig may be moved back and forth relative to the support bar in a direction parallel with its longitudinal center axis.

10 Claims, 3 Drawing Sheets

Fig.3

(56) References Cited

U.S. PATENT DOCUMENTS

| | | | | |
|---|---|---|---|---|
| 9,073,166 | B2 | 7/2015 | Fujimura | |
| RE46,941 | E | 7/2018 | Jansson | |
| 2005/0048885 | A1* | 3/2005 | Longbrake | B24D 15/08 451/367 |
| 2006/0258271 | A1* | 11/2006 | Naples | B24B 3/38 451/45 |
| 2011/0034111 | A1 | 2/2011 | Eleck et al. | |
| 2011/0177764 | A1 | 7/2011 | Schwartz | |
| 2013/0295825 | A1* | 11/2013 | Persson | B24B 3/36 451/367 |
| 2017/0113323 | A1 | 4/2017 | Persson | |
| 2019/0255673 | A1 | 8/2019 | Persson | |

FOREIGN PATENT DOCUMENTS

| | | | |
|---|---|---|---|
| EP | 1987916 | | 11/2008 |
| EP | 2324953 | | 5/2011 |
| EP | 2660005 | A2 | 11/2013 |
| EP | 2883655 | B1 | 6/2015 |
| JP | 2005193317 | A | 7/2005 |
| SE | 538902 | C2 | 1/2017 |
| WO | WO 2016195572 | A1 | 12/2016 |

OTHER PUBLICATIONS

European Search Report for EP Application No. 20167311.8 dated Sep. 7, 2020 (8 pages).

Swedish Office Action for Swedish Application No. 1950423-2 dated Sep. 23, 2019 (8 pages).

European Search Report for EP Application No. 20165128 dated Sep. 4, 2020 (8 pages).

Communication pursuant to Article 94(3) EPC for European Application No. 20 167 311.8 dated Feb. 10, 2022.

* cited by examiner

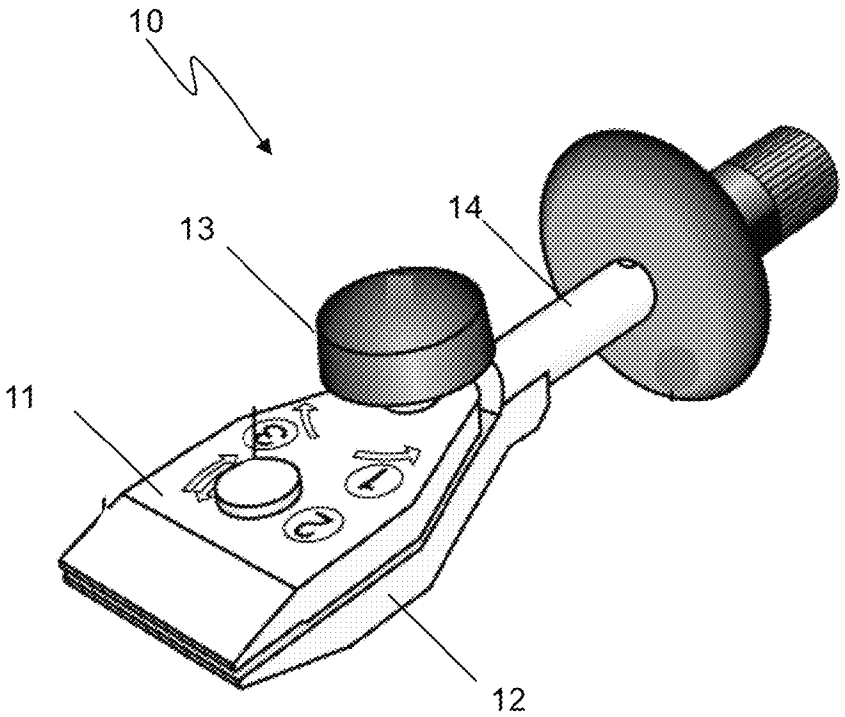
Fig.1 (Prior-Art)

GRINDING JIG FOR A BLADE TOOL

This application is claims benefit of Serial No. 1950422-4, filed 5 Apr. 2019 in Sweden and which application is incorporated herein by reference. To the extent appropriate, a claim of priority is made to the above disclosed application.

TECHNICAL FIELD

The present disclosure relates a grinding jig for a blade tool. The present disclosure also relates to a grinding machine with a grinding jig for a blade tool.

BACKGROUND ART

Grinding of blade tool, such as knives, which has edges with opposite edge bevels is typically made by clamping the blade tool in a grinding jig and moving the tool across a revolving grindstone. When the edge bevel on the first side of the tool has been sharpened, the grinding jig is turned over and moved in opposite direction across the grindstone so that edge bevel on the second side of the blade tool is sharpened.

FIG. 1 shows schematically a conventionally grinding jig 10 which comprises a lower clamp 12 that extends from a support pin 14 which in operation is guided on a transversal support bar of a grinding machine. An upper clamp half 11 is movable and may be forced against the lower clamp half by a screw 13 so that a blade tool (not shown) may be clamped by the upper and lower clamp halves.

While proven reliable in grinding operations, the conventional grinding jig has a drawback in that blade tool is not centered in the grinding jig. This has the effect that the angle between the blade and the grinding stone changes when the grinding jig (after completed grinding the first edge bevel) is turned over to grind the second edge bevel of the blade. The deviation of the edge bevel angles appears to increase with increasing blade thickness.

A further drawback with the conventional grinding jig is that it has shown to produce convex edges. The strength of the edge of the blade is reduced with increasing convexity.

Thus, there is a need for an improved grinding jig for blade tools.

Consequently, it is an object of the present disclosure to provide a grinding jig for blade tool that solves at least one of the problems of the prior-art.

In particular, it is an object of the present disclosure to provide a grinding jig which achieves a strong edge of a blade tool after grinding.

In addition, it is an object of the present disclosure to provide a grinding jig for a blade tool which achieves a minimum of difference between the angles of the edge bevels of the blade tool after grinding.

A further object of the present disclosure is to achieve a simple, yet robust, and easy to handle grinding jig for blade tools providing a minimum of difference between the angles of the edges of the blade tool after grinding.

SUMMARY OF THE INVENTION

According to the present disclosure, at least one of these objects is met by a grinding jig for holding a blade tool having an edge in a grinding machine, said grinding machine having a grindstone and a support bar for supporting a grinding jig, said grinding jig comprising:

a first and a second clamp half arranged to hold between them at least a portion of a blade tool, and;

an elongate support portion for supporting the grinding jig onto a support bar 350) of a grinding machine, characterized in that:

the elongate support portion 160) comprises a front end abutment surface and a rear end abutment surface for abutment against a support bar of a grinding machine, wherein;

the front and rear end abutment surfaces are spaced apart such that a portion of a support bar of a grinding machine may be received between the front and rear end abutment surfaces and such that the grinding jig may be moved back and forth relative the support bar, in direction parallel with the longitudinal center axis Y of the grinding jig.

The front end and rear end abutment surfaces allows the grinding jig to be moved in a controlled manner back and forth relative the support bar during grinding of the blade. Practical trials have shown that this controlled movement, limited between the front and rear abutment parts, results in that a convex bevel is achieved on the edges of the blade tool during grinding. Such convex edges are proven to be very strong.

It is appreciated that the grinding jig also may be moved back and forth along the support bar, in direction traverse to the longitudinal center axis Y of the grinding jig.

According to an alternative, the grinding jig may comprise a first and a second separate grinding jig half which are mutually facing each other and respectively comprises a clamp half and an elongate support portion half The grinding jig may thereby be arranged such that the first and the second grinding jig half may be releasably forced towards each other to hold a tool blade between the first and a second clamp half. The first and second grinding jig half comprise a respective front abutment half and a respective rear abutment part, wherein the front abutment halves and the rear abutment halves are arranged spaced apart from each other on the respective support portion half and configured for abutment with a support bar of a grinding machine.

Thus, the grinding jig according to this alternative comprises two separate jig halves which each include a clamp half and a support portion half. This has the effect that when a blade tool is clamped between the jig halves, both jig halves will be on the same distance from the center of the blade tool regardless the thickness of the blade. In particular, the first and the clamp will be on the same distance from the center of the blade and the first and second support portion will be on the same distance from the center of blade. Therefore, in a grinding operation there will be no, or negligible, change in angle between the blade and the grind stone regardless whether the first edge bevel or the second edge bevel of the blade is ground.

Further alternatives and advantages are disclosed in the appended claims and the following description.

BRIEF DESCRIPTION OF THE DRAWINGS

FIG. 1: A schematic drawing of a grinding jig according to the prior-art.

DETAILED DESCRIPTION OF EMBODIMENTS

The grinding jig according to the present disclosure will now be described more fully hereinafter. The grinding jig according to the present disclosure may however be embodied in many different forms and should not be construed as limited to the embodiments set forth herein. Rather, these embodiments are provided by way of example so that this disclosure will be thorough and complete, and will fully convey the scope of the present disclosure to those persons skilled in the art. Same reference numbers refer to same elements throughout the description.

Figure 2B:
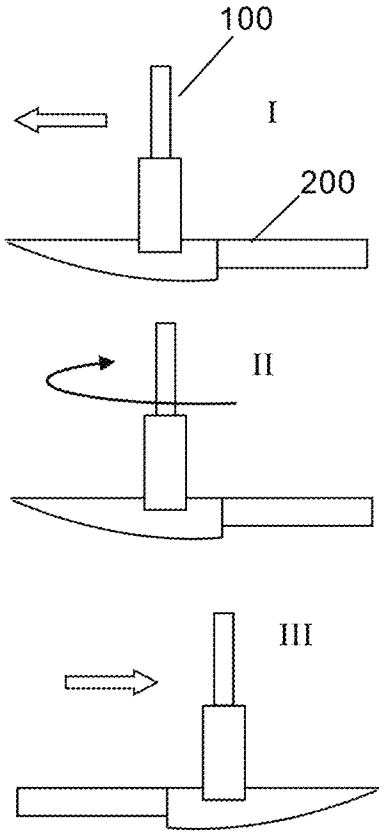
FIG. 2*b* A schematic drawing of a grinding operation
Figure 2A:
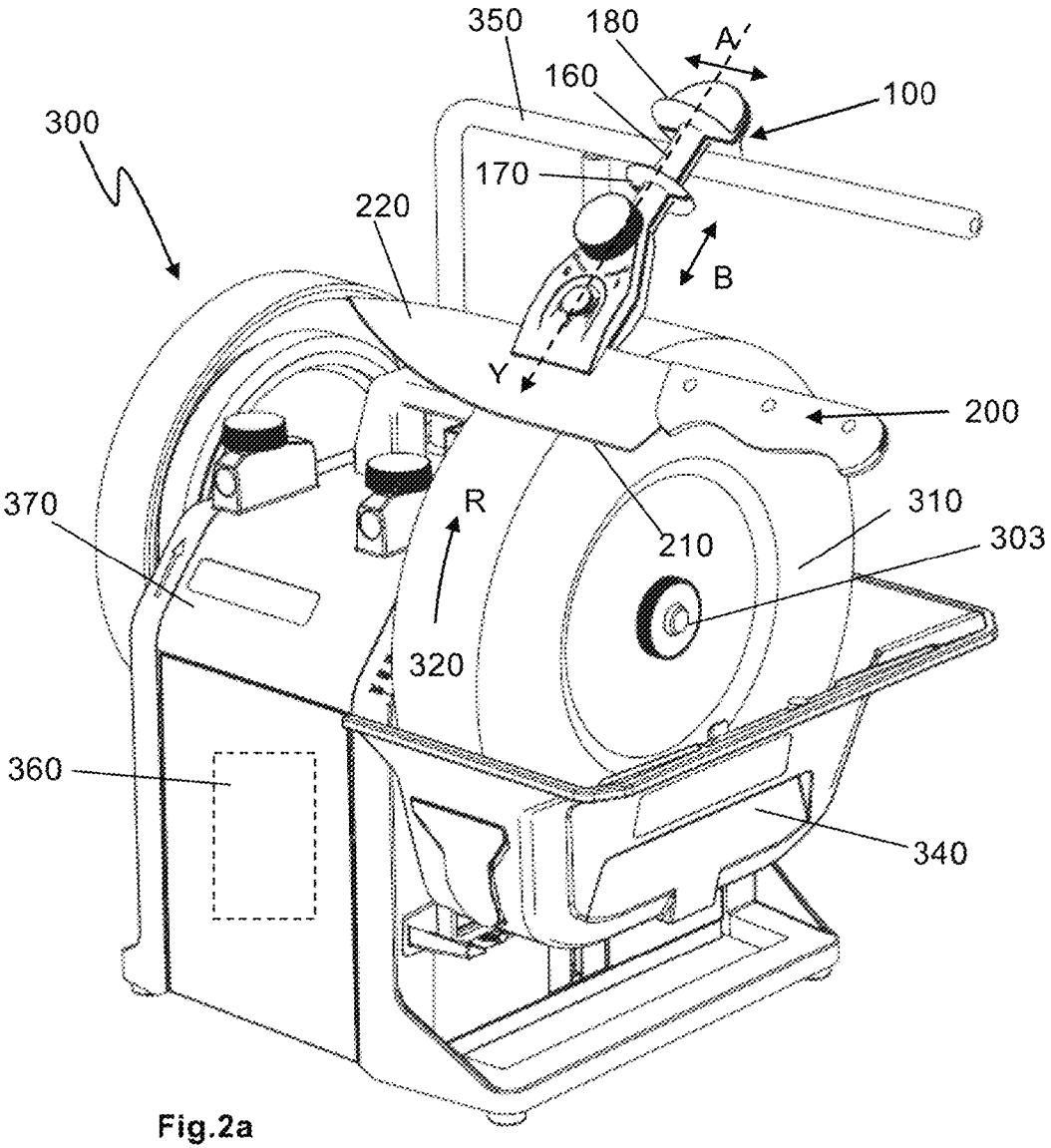
FIG. 2*a*: A schematic drawing of a grinding machine including a grinding jig according to the present disclosure.

FIG. 2*a* shows schematically a grinding machine 300 comprising a grinding jig 100 according to the present disclosure. A blade tool 200 to be ground is clamped in the grinding jig. The grinding machine 300 is of the bench type, i.e. it is of a design that allows it to be placed on a table in a workshop and to be operated manually by a person. The grinding machine 300 has a housing 370 and comprises a cylindrical grindstone 310 having a grinding surface 320. The grindstone 310 is rotated, in a rotation direction R, by a motor 360 which may be connected to a shaft 303 running through the center of the grindstone. The motor may for example be an electrical motor. A trough 340 for grinding liquid, such as water or oil, may be arranged underneath the grindstone. The grinding machine further comprises a support bar 350, also called universal support, for supporting the grinding jig 100. The support bar 300 extends over the grinding surface 320 traverse to the axis of rotation R of the grinding stone, i.e. parallel with the shaft 303. The grinding machine 300 may be any type of conventional grinding machine for grinding blade tools, such as knives. The knife may have a handle and a blade with a back and a symmetric edge (not shown) with two opposing edge bevels. Edge bevels may also be denominated "grind bevels". It is possible that the edge has one single edge bevel. The grinding machine may be a Tormek T-8 which is commercially available from the company Tormek AB.

In a grinding operation, as schematically indicated in FIG. 2*a*, the blade 200 is first (I) moved in a first direction (left) across the grindstone to grind a first side edge bevel of the blade. Then (II) the grinding jig 100 together with the blade is turned around. Subsequently (III), the blade 200 is moved in a second direction (right) across the grindstone to grind the second side edge bevel of the blade.

Figure 3:
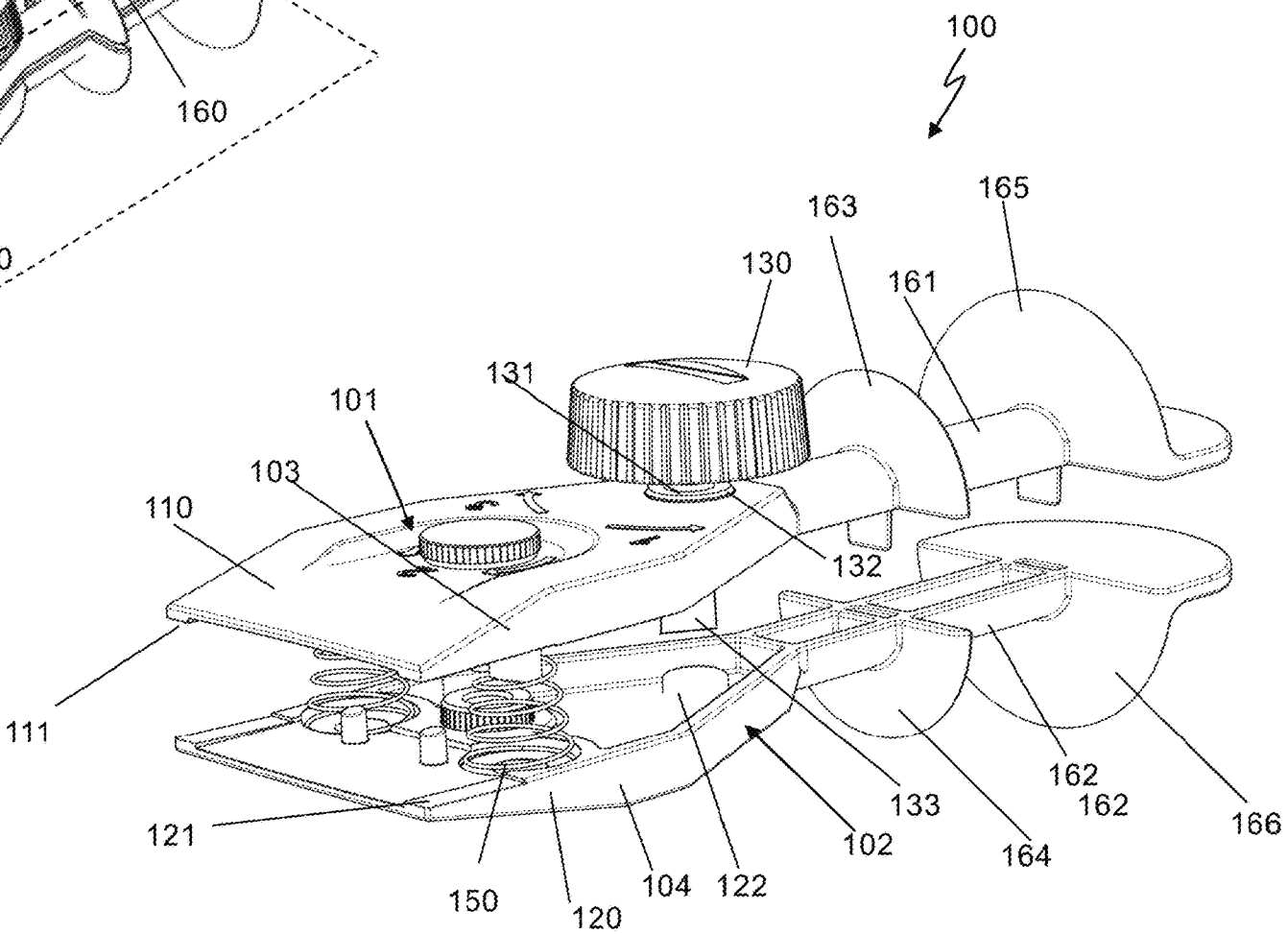
FIG. 3: A schematic exploded drawing of a grinding jig according to the present disclosure.

FIG. 3 shows the grinding jig according to an alternative of the present disclosure in an exploded view. Thus, the grinding jig may comprise a first grinding jig half 101 and a second grinding jig half 102. The first and second grinding jig half are separate from each other, meaning that they are not permanently joined or attached to each other. The first and second grinding jig half are thus movable towards and away from each other. The first and the second grinding jig half 101, 102 may be essentially identical. Thus, the first and second grinding jig half 101, may comprises respectively a clamp half 110, 120 for clamping a portion of a blade. The first and second clamp half comprises respectively a contact surface 111, 121 which are configured to engage a portion of the blade tool when it is clamped. Clamping of the blade is made over the back of the blade. The first and second contact portion 111, 121 forms the front end of the grinding jig. The first and second clamp half 110, 120 are designed with a width that is suitable for stable clamping of a bladed tool. Each grinding jig half 101, 102 may further comprises a respective elongate support portion half 161, 162 which respectively extends from the first and second clamp half 110, 120 in opposite direction to the front end. The elongate support portions 161, 162 terminate in a rear end of the grinding jig. The clamp halves 110, 120 and the elongate support portions 161, 162 of the first and the second grinding jig halves 101, 102 may be attached to each other or formed integral to each other. For example, the respective grinding jig halves 101, 102 may be manufactured in one single piece by moulding. Alternatively, the clamp halves and the support halves may be manufactured separately and attached to each other by gluing or welding. The grinding jig halves may be manufactured in plastic such as poly-propene or in metal. Each grinding jig half 101, 102 may thus be an integral piece. As shown in FIG. 1, the first and the second grinding jig half 101, 102 may be formed as hollow shells and may have a respective circumferential border 103, 104. The contact portions 111, 121 may be part of the border 103, 104 of the respective grinding jig half.

The first and the second grinding jig half are arranged mutually facing each other. That is, such that the contact portion 111, 121 of the respective grinding jig half 101, 102 faces each other.

The grinding jig 100 may further comprises an actuator 130 which is arranged to releasably force the first and the second grinding jig half 101, 102 towards each other. The clamping halves 110, 120 of the respective first and second grinding jig half may thereby be brought together with sufficient force to securely hold a portion of blade tool. The actuator 130 is coupled to the first and the second grinding jig half such that it may bring and hold the first and second grinding jig half together and may release the first and second grinding jig half from each other. In the disclosed embodiment, the actuator 130 may be a screw which extends through an opening 131 in the first jig half 101. The screw may have a ring-shaped shoulder 132 that rests on the first grinding jig half 101. The end of the screw 133 has a threaded portion which engages a threaded opening 122 in the second grinding jig half 102. Turning of the actuator 130 in one direction forces the first and second grinding jig half 101, 102 towards each other. Turning of the actuator 130 in opposite direction releases the tension between the first and second grinding jig half 101, 102 and allows them to move away from each other.

A resilient member 150 may be arranged between the first and second grinding jig half 101,102 for biasing the grinding jig halves away from each other.

The actuator 130 for releasably forcing the first and the second grinding jig half 101, 102 towards each other may be realized in other modes. For example, the actuator may be cam-lever arrangement or a ratchet arrangement.

Each grinding jig half 101, 102 may further comprise a respective front abutment half 163, 164 and a respective rear abutment part 165, 166. The front abutment halves 163, 164 and the rear abutment halves 165, 166 are arranged spaced apart from each other on the respective support portion half 161, 162. The front and rear abutment halves protrude perpendicular from the respective support portion half 161 and 162 and may be in the form of half discs.

Figure 4:
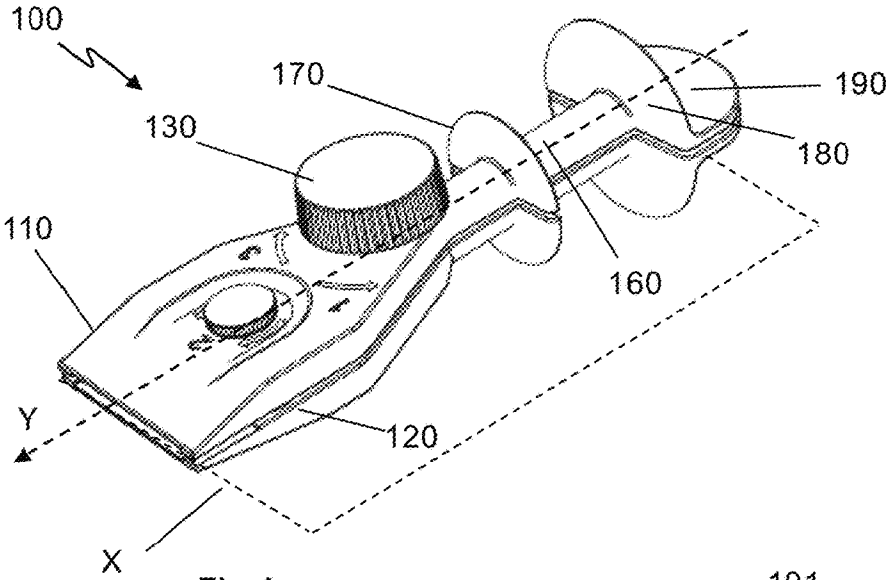
FIG. 4: A schematic drawing of a grinding jig according to the present disclosure.

FIG. 4 shows the grinding jig 100 according to the present disclosure in assembled state. Thus, the grinding jig 100, comprises a first and second clamp half 110, 120 for clamping a portion of a blade. The first and second clamp half comprises respectively a contact surface 111, 121 (see FIG. 3) for engaging the back of a blade tool such as a knife or a scissor. The first and second contact portion 111, 121 forms the front end of the grinding jig. The grinding jig 100 further comprises an elongate support portion 160 which may be rod-shaped. The support portion 160 extends from the first and second clamp half 110, 120 in direction opposite to the front end of the grinding jig. The support portion 160 terminates in a rear end of the grinding jig. In use, the support portion 160 is intended to be supported onto the support bar of a grinding machine and there by assist the operator thereof to maintain the angle of a blade relative the grindstone.

The elongated support portion 160 comprises a front end abutment surface 170 and a rear end abutment surface 180. The front and rear end abutment surfaces 170, 180 are spaced apart such that a portion of a support bar of a grinding machine may be received there between. The front and rear end abutment surfaces 170, 180 are thereby spaced apart sufficiently to allow the operator to move the grinding jig 100 back and forth relative the support bar 350.

In detail, the front and rear end abutment surfaces 170, 180 are aligned along a longitudinal center axis Y of the grinding jig 100. The axis Y extends through the front end of the grinding jig, the clamp halves 110, 120, the support portion 160 and the rear end of the grinding jig. The rear end abutment surface 180 is thereby arranged after the rear end 190 of the grinding jig and the front end abutment surface 170 is arranged after the rear end abutment surface 180 and the clamp halves 110, 120 are arranged after the front end abutment surface 170.

The front and rear end abutment surfaces may extend perpendicular from the support portion 160 and around its circumferential and may thereby have the form of discs. The distance, by which the front and the rear end abutment surfaces are spaced apart is selected such that the distance is greater than the diameter of the support bar of a grinding machine and such that it allows a slight movement back and forth of the grinding jig 100 when it is supported on the support bar. For example, the distance between the front and rear end abutment surfaces is 2-5 cm. The height of the front and rear end abutment surfaces 170, 180 is selected such the support bar of a grinding machine is prevented from passing beyond the front and rear end abutment surfaces 170, 180 when the grinding jig is 100 is moved back and forth relative the support bar. For example, the height is 1-2 cm.

The rear end of the support portion 160 may terminate in a handle portion 190 which is configured to be griped by an operator of the grinding jig.

The grinding jig may be split into two separate halves that are on opposite sides of a central plane x extending through the center of the grinding jig.

The advantage of the spaced apart front and rear abutment surfaces 170, 180 is that they make possible to achieve convex edge bevels during grinding of bladed tools.

The function of the grinding jig 100 according to the present disclosure is in the following described with reference to FIG. 2*a*. Thus, in a grinding operation, the operator supports the elongated support portion 160 of the grinding jig onto the support bar 350 such that the bevel 210 of the bladed tool 200 is resting in a proper angle on the surface 320 of the grindstone 310. The operator may then move the grinding jig 100 along the support bar 350 back and forth in direction traverse to the longitudinal axis Y of the grinding jig 100 as indicated by arrow A. In other words, traverse to the rotating direction R of the grindstone 310.

Simultaneously, the operator may move the grinding jig 100 relative the support bar 350 back and forth in direction parallel with the longitudinal axis Y of the grinding jig 100 as indicated by arrow B. In other words, parallel with the rotation direction R of grindstone 310.

The movement back and forth of the grinding jig 100 relative the support bar 350 in direction parallel with its longitudinal axis Y is restricted by the front and rear end abutment surfaces 170, 180 of the grinding jig 10. The rear end abutment surface 180 there by restricts movement of the grinding jig in one direction, e.g. away from the support bar 350, The front end abutment surface 170 restricts movement in opposite direction, e.g. towards the support bar 350.

The movement back and forth of the grinding jig 100 in direction parallel with its longitudinal axis Y results in an edge with convex edge bevels after grinding. Edges with convex edge bevels are stronger than edges with concave or straight edge bevels.

The front and rear end abutments surfaces 170, 180 thereby assists the operator to control the movement of the grinding jig 100 such that a beveled edge 210 is achieved on the bladed tool 220. The distance between the front and rear abutment surfaces 170, 180 controls the shape of the final edge and may be selected on basis of practical trials.

Although a particular embodiment has been disclosed in detail this has been done for purpose of illustration only, and is not intended to be limiting. In particular, it is contemplated that various substitutions, alterations and modifications may be made within the scope of the appended claims.

The invention claimed is:

1. A grinding jig for holding a blade tool having an edge in a grinding machine, said grinding machine, the grinding jig comprising:

first and second clamp halves arranged to hold between them at least a portion of a blade tool;

an elongate support portion for supporting the grinding jig onto a support bar of a grinding machine, wherein the elongate support portion comprises a front end abutment surface and a rear end abutment surface for abutment against a support bar of the grinding machine, and wherein the front and rear end abutment surfaces protrude radially outward from the support portion and are spaced apart such that a portion of the support bar of the grinding machine may be received between the front and rear end abutment surfaces such that the grinding jig may slide back and forth between the front and rear abutment surfaces, relative the support bar, in a direction parallel with the longitudinal center axis of the grinding jig;

first and second separate grinding jig halves, which are mutually facing each other and respectively comprise the first and second clamp halves and respectively comprise first and second halves of the elongate support portion; and wherein the grinding jig is arranged such that the first and second separate grinding jig halves may be releasably forced towards each other to hold the blade tool between the first and second clamp halves via an actuator and wherein the first and second separate grinding jig halves each comprises a respective front abutment half and a respective rear abutment half that include respectively the front and rear abutment surfaces, wherein the front abutment halves and the rear abutment halves are arranged spaced apart from each other on the respective first and second portions of the first and second halves of the elongate support portion and configured for abutment with the support bar of the grinding machine.

2. The grinding jig according to claim 1, whereby movement of the grinding jig in one direction is limited by one of the front or rear end abutment surfaces and movement of the grinding jig in the opposite direction is limited by the other of the front or rear end abutment surfaces.

3. The grinding jig according to claim 1, wherein the front and rear end abutment surfaces respectively extend around the circumferential of the support portion.

4. The grinding jig according to claim 1, wherein the front end and the rear end abutment surfaces extends perpendicular from the support portion.

5. The grinding jig according to claim 1, wherein the first and second clamp halves comprises a respective contact surface for engagement with a side of a blade tool and wherein the respective half of the elongate support portion extends from the respective clamp half opposite to the contact surfaces.

6. The grinding jig according to claim 5, wherein the first and the second separate grinding jig halves are substantially identical.

7. The grinding jig according to claim 1, wherein the each respective clamp half is attached to or formed integral with the respective half of the elongate support portion.

8. The grinding jig according to claim 1, further comprising a resilient member for biasing the first and second separate grinding jig halves away from each other.

9. The grinding jig according to claim 1, wherein the blade tool is a knife.

10. A grinding machine comprising:

a grindstone, a motor for rotating the grindstone, a support bar; and a grinding jig supported by the support bar, wherein the grinding jig comprises:

first and second clamp halves arranged to hold between them at least a portion of a blade tool;

an elongate support portion for supporting the grinding jig onto the support bar of the grinding machine, wherein the elongate support portion comprises a front end abutment surface and a rear end abutment surface for abutment against the support bar of the grinding machine, and wherein the front and rear end abutment surfaces protrude radially outward from the support portion and are spaced apart such that a portion of the support bar of the grinding machine may be received between the front and rear end abutment surfaces such that the grinding jig may slide back and forth between the front and rear abutment surfaces, relative the support bar, in a direction parallel with the longitudinal center axis of the grinding jig;

first and second separate grinding jig halves, which are mutually facing each other and respectively comprise the first and second clamp halves and respectively comprise first and second halves of the elongate support portion; and wherein the grinding jig is arranged such that the first and the second separate grinding jig halves may be releasably forced towards each other to hold the blade tool between the first and second clamp halves via an actuator and wherein the first and second separate grinding jig halves each comprises a respective front abutment half and a respective rear abutment half that include respectively the front and rear abutment surfaces, wherein the front abutment halves and the rear abutment halves are arranged spaced apart from each other on the respective first and second portions of the first and second halves of the elongate support portion and configured for abutment with the support bar of the grinding machine.

* * * * *